US011344939B2

(12) United States Patent
Kapp

(10) Patent No.: US 11,344,939 B2
(45) Date of Patent: May 31, 2022

(54) DEVICE FOR CALIBRATING AND STRAIGHTENING HOLLOW COMPONENTS AND METHOD USING SUCH A DEVICE

(71) Applicant: Theodor Gräbener GmbH & Co. KG, Netphen-Werthenbach (DE)

(72) Inventor: Dieter Kapp, Wilnsdorf (DE)

(73) Assignee: Theodor Gräbener GmbH & Co. KG, Netphen-Werthenbach (DE)

( * ) Notice: Subject to any disclaimer, the term of this patent is extended or adjusted under 35 U.S.C. 154(b) by 477 days.

(21) Appl. No.: 16/311,017

(22) PCT Filed: Jun. 14, 2017

(86) PCT No.: PCT/EP2017/064507
§ 371 (c)(1),
(2) Date: Dec. 18, 2018

(87) PCT Pub. No.: WO2017/220393
PCT Pub. Date: Dec. 28, 2017

(65) Prior Publication Data

US 2019/0176200 A1 Jun. 13, 2019

(30) Foreign Application Priority Data

Jun. 22, 2016 (DE) ..... 10 2016 007 546.5

(51) Int. Cl.
*B21D 3/14* (2006.01)
*B21D 35/00* (2006.01)
(Continued)

(52) U.S. Cl.
CPC ..... *B21D 3/14* (2013.01); *B21D 3/10* (2013.01); *B21D 5/015* (2013.01); *B21D 5/10* (2013.01); *B21D 35/002* (2013.01); *B21D 37/14* (2013.01)

(58) Field of Classification Search
CPC . B21D 3/00; B21D 3/045; B21D 3/10; B21D 3/14; B21D 3/16; B21D 37/00;
(Continued)

(56) References Cited

U.S. PATENT DOCUMENTS 2,848,095 A * 8/1958 Dolle ..... B65G 47/54 198/535
3,002,479 A * 10/1961 Johansen ..... B21D 37/14 72/412

(Continued)

FOREIGN PATENT DOCUMENTS

DE 102008027807 A1 6/2008
EP 0694348 A1 6/1995

(Continued)

OTHER PUBLICATIONS

Translation—Byroslawsky—EP0694348B1—Translated Mar. 30, 2021 (Year: 2000).*

(Continued)

*Primary Examiner* — Jessica Cahill
*Assistant Examiner* — Jared O Brown
(74) *Attorney, Agent, or Firm* — Dickinson Wright PLLC; Andrew D. Dorisio

(57) ABSTRACT

Device (1) for calibrating and straightening hollow components, preferably welded pipes (2), the device (1) being substantially composed of a frame (5) having two side stands (6, 7), a lower cross member (8) and an upper cross member (9), a ram (10) being provided, said ram (10) being movable toward the lower cross member (8) and back by means of a pressure-operable cylinder assembly (12) supported on the upper cross member (9), and a calibrating and straightening tool (11*a*) being provided between the lower cross member (8) and the ram (10), wherein the calibrating and straightening tool (11*a*) is changeably disposed on the
(Continued)

Figure 1:
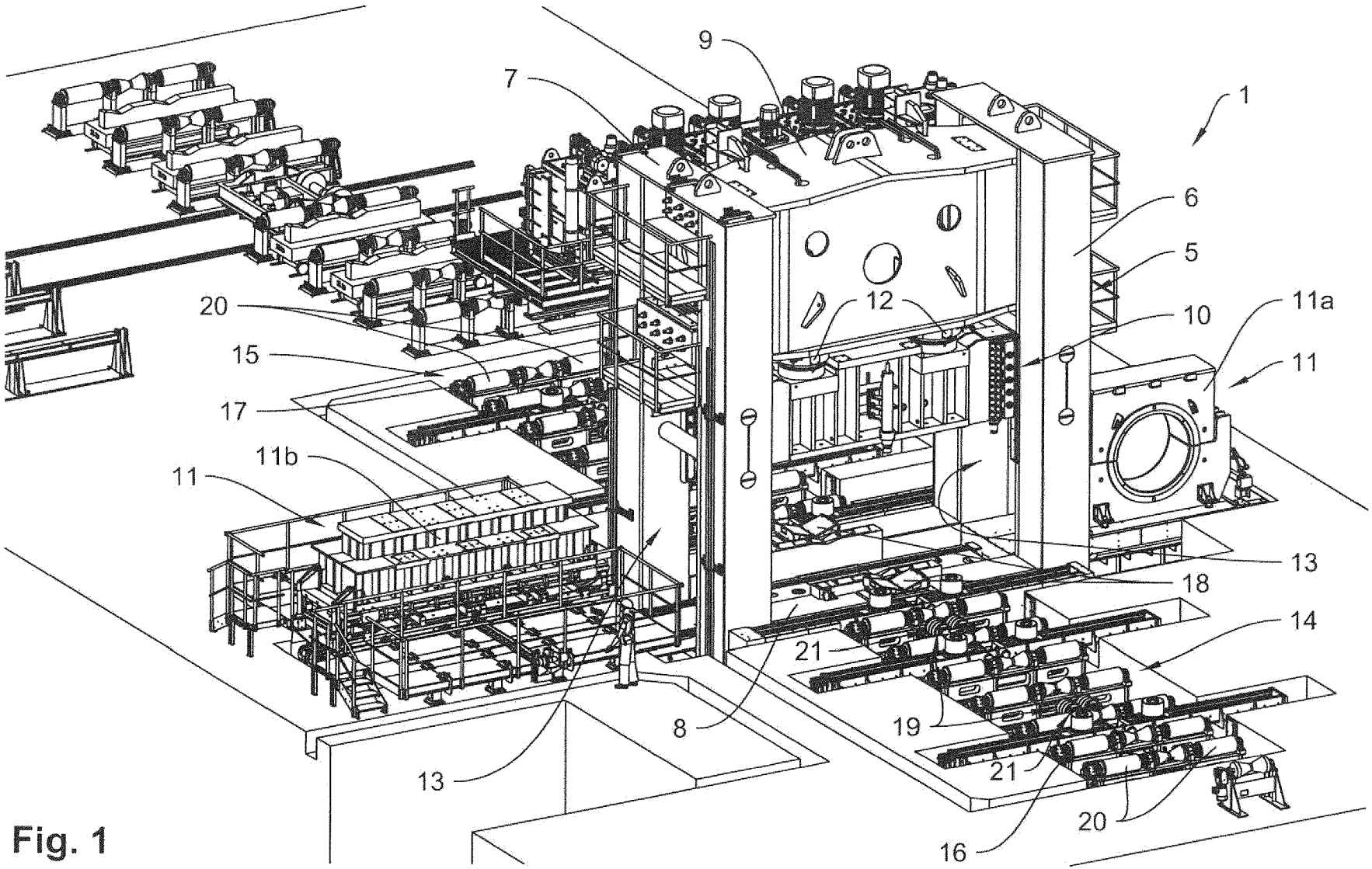

lower cross member (8) and on the ram (10) and can be replaced with a bending tool (11*b*) for bending the lateral ends (3) of sheets (4) to produce pipes (2).

11 Claims, 5 Drawing Sheets

(51) Int. Cl.

| | |
|---|---|
| ***B21D 3/10*** | (2006.01) |
| ***B21D 5/01*** | (2006.01) |
| ***B21D 5/10*** | (2006.01) |
| ***B21D 37/14*** | (2006.01) |

(58) Field of Classification Search
CPC ..... B21D 37/04; B21D 37/14; B21D 37/145; B21D 37/147; B21D 35/00; B21D 5/00; B21D 5/002; B21D 5/01; B21D 5/015; B21D 5/06; B21D 5/10; B21D 5/12; B21D 5/14; B21D 43/003; B21D 35/002
See application file for complete search history.

(56) References Cited

U.S. PATENT DOCUMENTS

| | | | | | |
|---|---|---|---|---|---|
| 3,111,100 | A * | 11/1963 | Georgeff | B21D 37/14 | 72/414 |
| 4,143,755 | A * | 3/1979 | Keller | B65G 47/54 | 198/456 |
| 4,255,860 | A * | 3/1981 | Ragettli | B21D 3/10 | 33/501 |
| 2018/0056357 | A1* | 3/2018 | Kubinger | B21D 5/0281 | |

FOREIGN PATENT DOCUMENTS

| | | | | |
|---|---|---|---|---|
| EP | 0694348 | A1 * | 1/1996 | B21D 37/145 |
| EP | 0694348 | B1 * | 11/2000 | B21D 5/015 |
| FR | 1334822 | A * | 8/1963 | B21D 3/10 |
| JP | H11156440 | A | 6/1999 | |
| JP | 2005324255 | A | 11/2005 | |

OTHER PUBLICATIONS

Translation—Ofeld—FR1334822A—Translated Apr. 20, 2021 (Year: 1963).*

* cited by examiner

DEVICE FOR CALIBRATING AND STRAIGHTENING HOLLOW COMPONENTS AND METHOD USING SUCH A DEVICE

BACKGROUND OF THE INVENTION

The invention relates to a device for calibrating and straightening hollow components, preferably welded pipes, the device being substantially composed of a frame having two side stands, a lower cross member and an upper cross member, a ram being provided, said ram being movable toward the lower cross member and back by means of a pressure-operable cylinder assembly which is supported on the upper cross member, and a calibrating and straightening tool being provided between the lower cross member and the ram, and to a method using such a device.

Devices of this kind, which are also referred to as calibrating and straightening presses, are sufficiently known. These devices and presses have the disadvantage that they can be used for one application only, namely calibrating and straightening of hollow components in this case.

The object of the invention is to provide a device of the kind mentioned above whose scope of functions is broadened, an increase in efficiency being achieved by a substantially improved use of the production capacities available.

According to the invention, this object is attained by a device and by a method as claimed.

Advantageous embodiments of the invention are characterized in the dependent claims.

In the device according to the invention, the calibrating and straightening tool is changeably disposed on the lower cross member and on the ram and can be replaced with a bending tool for bending the lateral ends of sheets to produce pipes. With the option of incorporating different tools for different tasks in the device, no additional investments for an additional system, such as a bending press, are necessary.

The calibrating and straightening tool and the bending tool can each be moved from a parking and changing position outside the frame of the device into a working position within the frame of the device and back. The parking and changing position for the tools outside the device allows configuration of the tool not currently needed while the device is being used with the other tool.

The parking and changing position of the calibrating and straightening tool can be provided sideways next to one of the two side stands of the frame, and the parking and changing position of the bending tool can be provided sideways next to the other side stand of the frame, wherein the same through-openings for moving the calibrating and straightening tool and the bending tool from the respective parking and changing positions into the central working position can be formed in each of the two side stands. This arrangement ensures a relatively easy and quick tool change because changing and moving the tools merely requires a linear movement, whereby elaborate constructions and accompanying high costs are largely avoided.

SUMMARY OF THE INVENTION

The calibrating and straightening tool and the bending tool can be form-fittingly receivable by the ram, wherein pressure-operable clamping means on and in the ram can clamp the calibrating and straightening tool and the bending tool. Form-fitting reception of the tools in connection with clamping of the tools ensures that the tools are securely and tightly held at the ram.

A feeding device for the pipe to be calibrated and straightened and for the sheet to be bent and a discharging device for the calibrated and straightened pipe and for the bent sheet can be assigned to the device. The feeding device and the discharging device allow relatively large pipes and sheets to be fed to and discharged from the tools on the one hand and the workpieces to be cyclically or continuously conveyed through the tools on the other hand.

The feeding device can be formed by an inlet roller conveyor and the discharging device can be formed by an outlet roller conveyor, wherein the inlet roller conveyor and the outlet roller conveyor can be liftable and lowerable. By lowering the roller conveyors, in particular the sheets rest freely in the forming or bending tool during the forming process.

Upstream and downstream of the calibrating and straightening tool in the conveying direction, the device can have centrally disposed V-blocks for the respective pipe, each of which can be moveable in the vertical direction by means of at least one pressure-operable cylinder. The V-blocks ensure the actual straightening of the pipes.

In the area of the inlet roller conveyor and/or of the outlet roller conveyor, a centrally disposed rotating device for rotating the respective pipe and/or for laterally positioning the respective sheet during bending can be provided. Once the roller conveyors have been lowered, the respective pipe can be very easily rotated into the correct position for straightening and the respective sheet can be very easily laterally positioned using the rotating device. Furthermore, a centering device for centering the respective sheet can be provided.

The rotating device can be composed of multiple motor-driven roller pairs disposed between parallel rollers of the inlet roller conveyor and/or of the outlet roller conveyor and extending perpendicular to the rollers of the inlet roller conveyor and/or of the outlet roller conveyor. The motor-driven roller pairs allow precise positioning of the pipe for straightening.

In the method according to the invention for calibrating and straightening hollow components, preferably welded pipes, and for bending lateral ends of sheets to produce pipes using a device for that purpose, in order to calibrate and straighten a pipe or multiple pipes, the calibrating and straightening tool is moved from its parking and changing position into the working position, the ram of the device being subsequently moved toward the calibrating and straightening tool and the calibrating and straightening tool being form-fittingly received by the ram and fixed thereto. Then, the respective pipe is fed to the calibrating and straightening tool by means of the inlet roller conveyor and is gradually calibrated within the calibrating and straightening tool according to the dimensions of the calibrating and straightening tool. Once each individual step of calibration is complete, the pipe may be straightened, the rotating device, after lowering of the inlet roller conveyor and/or of the outlet roller conveyor, rotating the respective pipe into the correct position for straightening, and the V-blocks being moved against the pipe upon arrival of the pipe in the correct position, the pipe being straightened by the force acting against the pipe. Following full calibration and full straightening of the pipe, the pipe is conveyed away from the calibrating and straightening tool via the outlet roller conveyor. Once calibration and straightening of a single pipe or multiple pipes is complete, the calibrating and straightening tool is detached from the ram of the device and is moved from the working position into its parking and changing position.

In order to bend the lateral ends of sheets to produce pipes, the bending tool is moved from its parking and changing position into the working position, the ram being subsequently moved toward the bending tool and the bending tool being form-fittingly and force-fittingly received by the ram of the device. The respective sheet is then centered by means of the centering device and/or the rotating device and is fed to the bending tool by means of the inlet roller conveyor, the sheet is clamped, and then the longitudinal edges of the sheet are simultaneously bent in parallel on both sides in a cycled process or a continuous process, at least the inlet roller conveyor being in the lowered position during bending. When the sheet is cycled or conveyed onward, the roller conveyor is lifted again, the bending tool is opened and the sheet is unclamped, the next bending step taking place once the sheet has been moved by the predefined increment. Once fully bent, the sheet is conveyed away from the bending tool via the outlet roller conveyor. Once bending of a single sheet or multiple sheets is complete, the bending tool is detached from the ram of the device and is moved from the working position into its parking and changing position.

Hereinafter, a preferred embodiment of the device according to the invention and the method according to the invention will be discussed in more detail with reference to the drawing.

BRIEF DESCRIPTION OF THE DRAWING FIGURE

Figure 2:
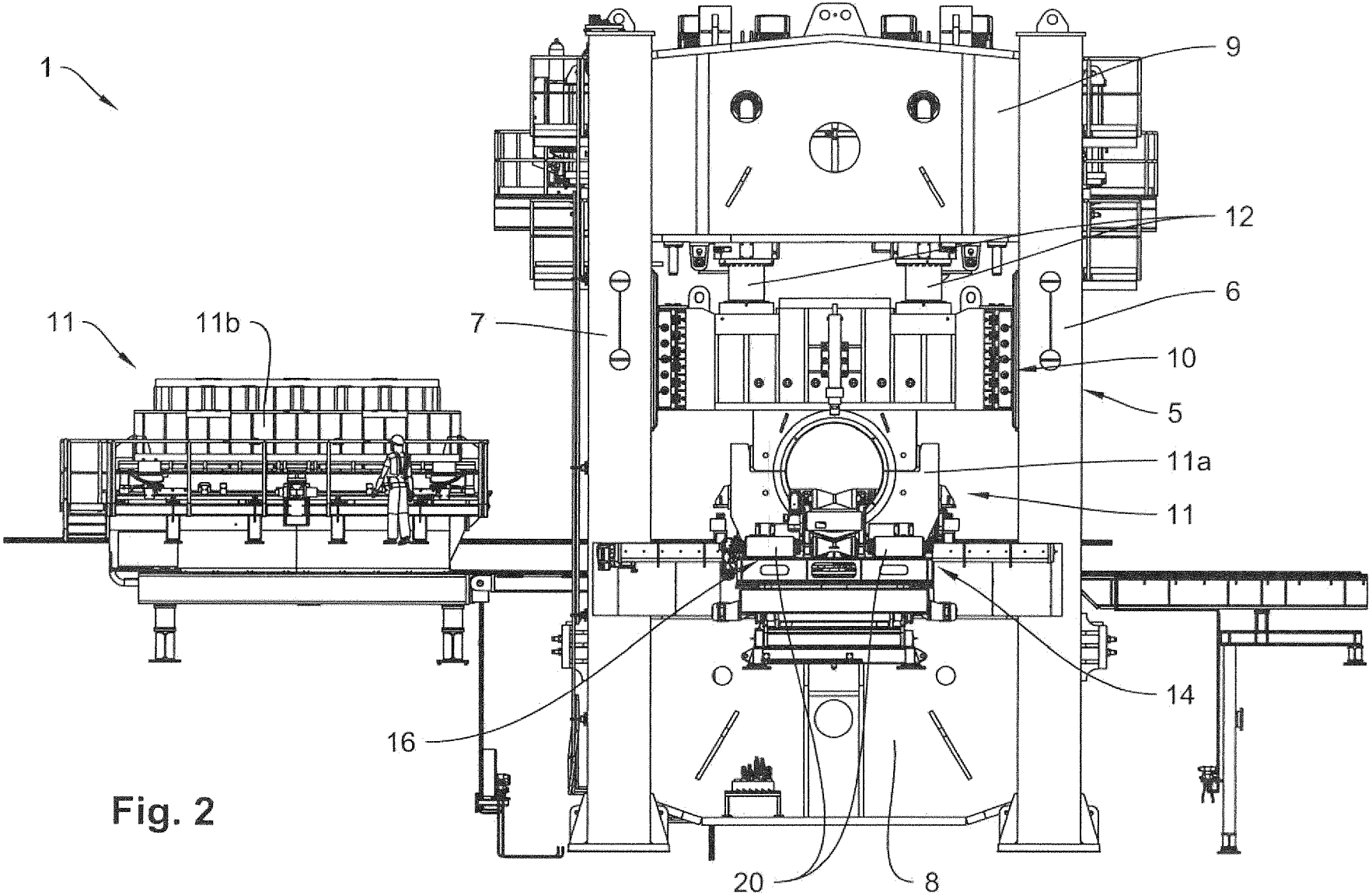
Figure 3:
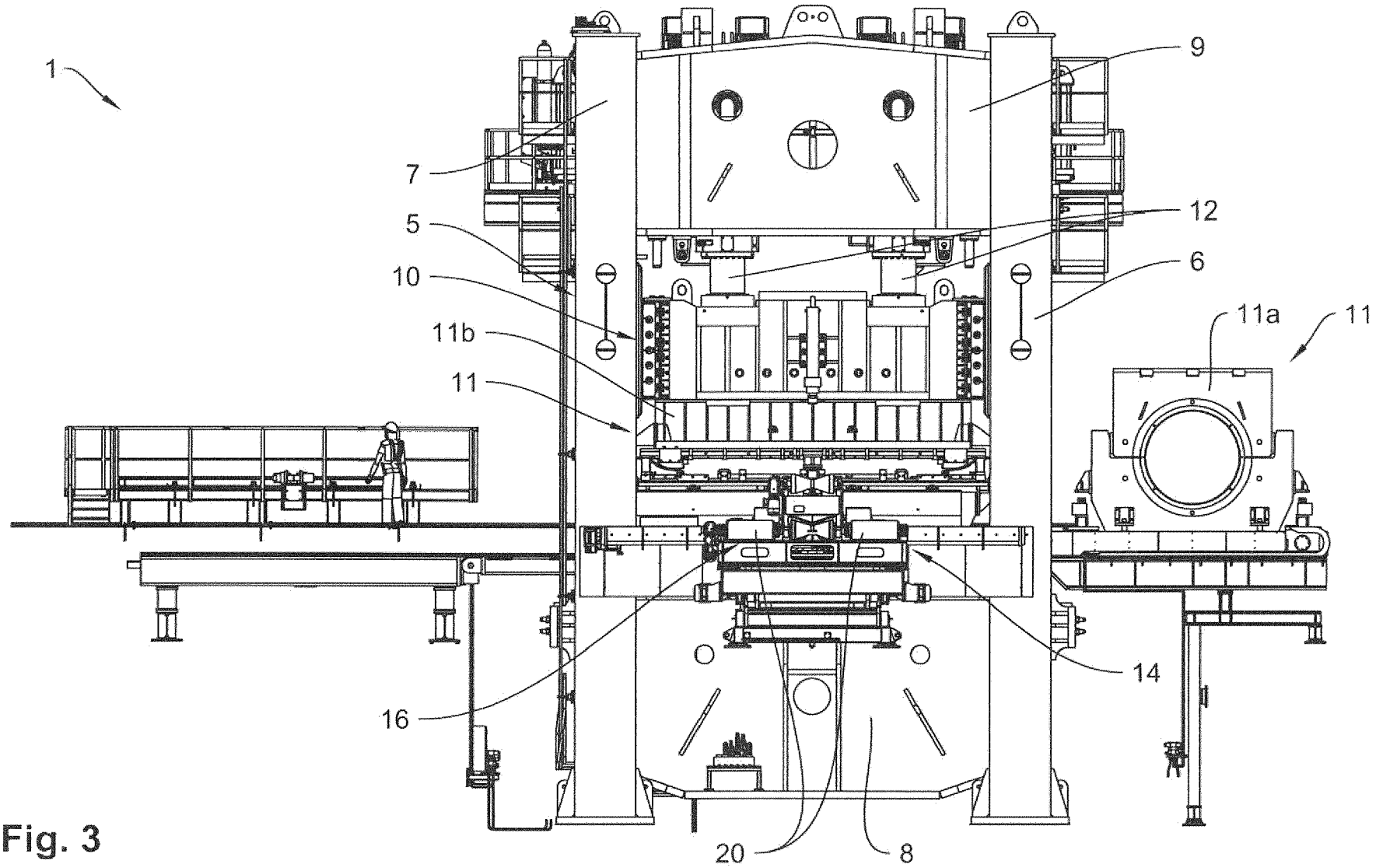
Figure 4:
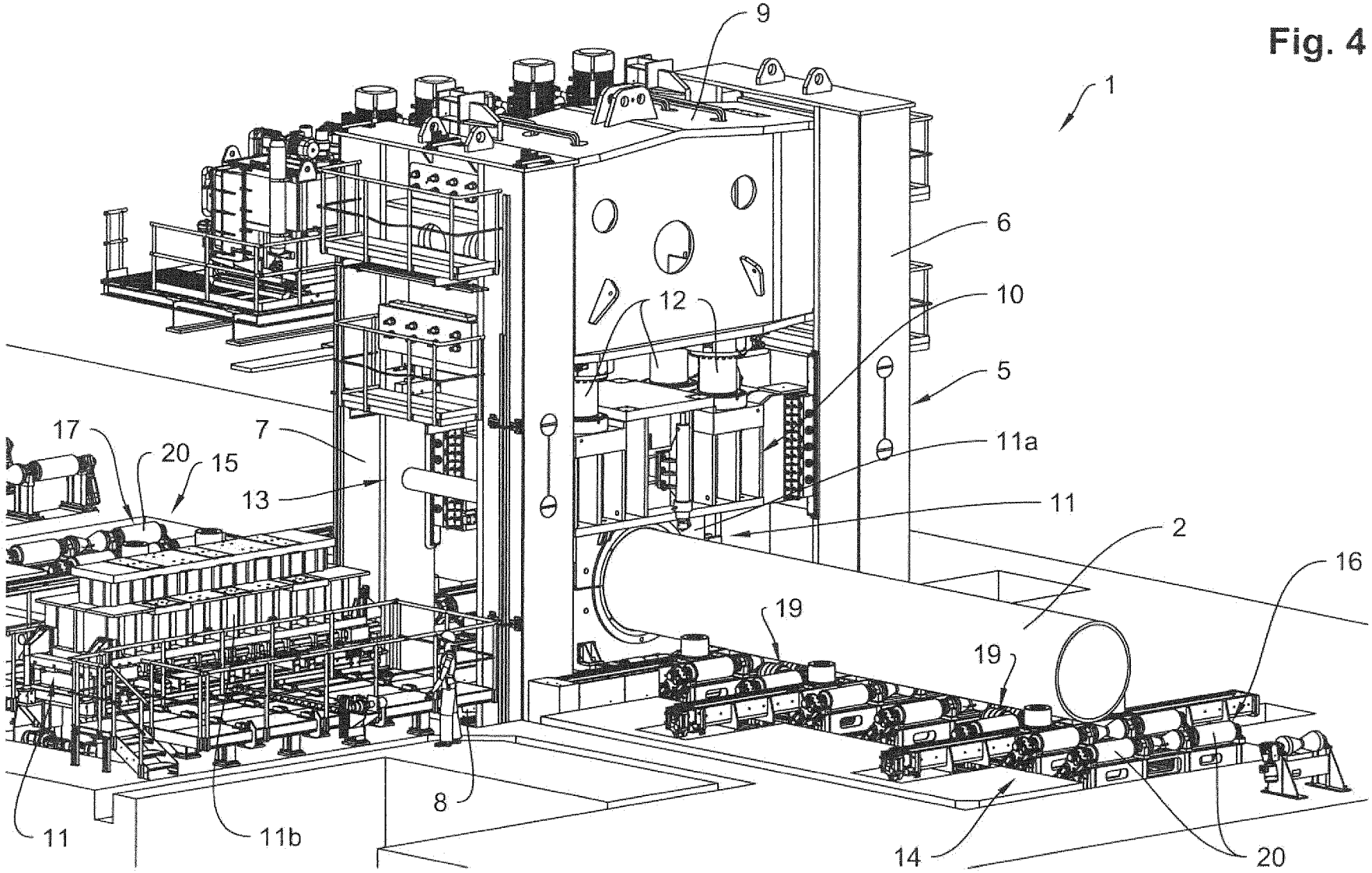
Figure 5:
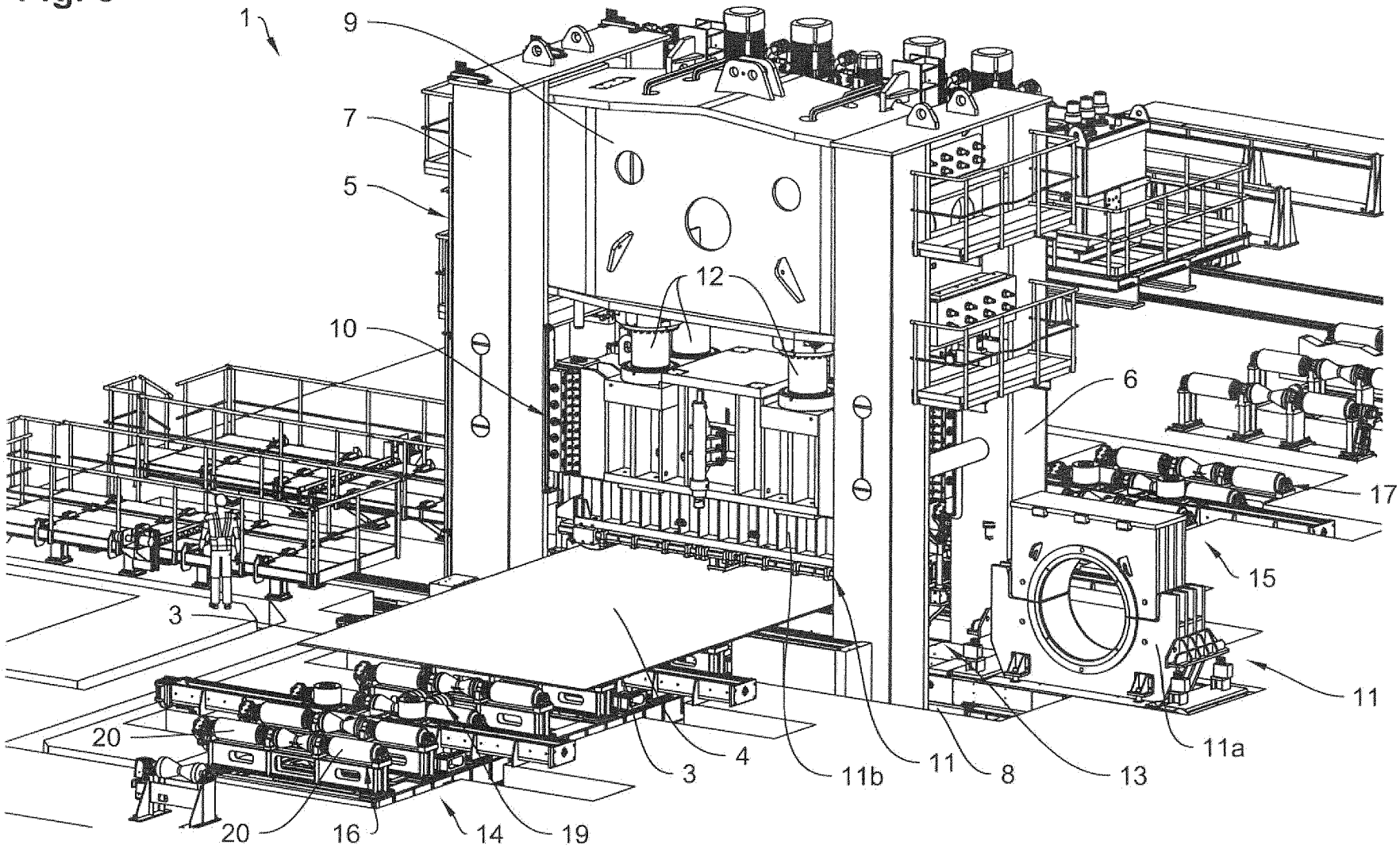

FIG. 1 is a perspective illustration showing a device having an inlet roller conveyor and an outlet roller conveyor and a calibrating and straightening tool and a bending tool located in the parking and changing position, FIG. 2 shows a front view of the device with the calibrating and straightening tool located in the working position and with the bending tool located in the parking and changing position, FIG. 3 shows a front view of the device with the bending tool located in the working position and with the calibrating and straightening tool located in the parking and changing position, FIG. 4 is a perspective illustration showing the device with the calibrating and straightening tool located in the working position and accommodating a pipe and with the bending tool located in the parking and changing position, and FIG. 5 is a perspective illustration showing the device with the bending tool located in the working position and accommodating a sheet and with the calibrating and straightening tool located in the parking and changing position.

DETAILED DESCRIPTION OF THE INVENTION

The device 1 illustrated in FIGS. 1 to 5 serves to calibrate and straighten hollow components, preferably welded pipes 2, on the one hand and for bending lateral ends 3 of sheets 4 in order to produce pipes 2 on the other hand and is substantially composed of a frame 5 having two side stands 6, 7, a lower cross member 8 and an upper cross member 9, each of the two side stands 6, 7 being flanged to the lateral ends of the lower cross member 8 and of the upper cross member 9 and fixed by means of a screw connection.

A ram 10 which serves to accommodate changeable forming tools 11 and which can be moved vertically toward the lower cross member 8 and back is mounted on the fixed upper cross member 9. For moving the ram 10, a pressure-operable cylinder assembly 12 is disposed between the upper cross member 9 and the ram 10. In the embodiment of the device 1 illustrated in FIGS. 1 to 5, a cylinder assembly 12 comprising four cylinders 12, for example, is illustrated, said cylinders 12 ensuring controlled movement, closure, pressing and opening of the forming tools 11, the pressure fluid used preferably being hydraulic oil. The forming tools 11 are a calibrating and straightening tool 11*a* for the pipes 2 on the one hand and a bending tool 11*b* for the lateral ends 3 of the sheets 4 on the other hand.

When they are not in use, or for configuration, each of the two forming tools 11 is stored in a parking and changing position outside of the frame 5 of the device 1. The forming tools 11 can be moved from said parking and changing positions into their working position and back, wherein, when in the working position, the forming tools 11 are form-fittingly received by the ram 10 after the latter has been lowered. For the forming tools 11 to be permanently fixed to the ram 10 during forming, the ram 10 has pressure-operable clamping means, the pressure fluid used preferably being hydraulic oil in this case, too.

The parking and changing position of the calibrating and straightening tool 11*a* is provided sideways next to one of the two side stands 6, 7 of the frame 5, and the parking and changing position of the bending tool 11*b* is provided sideways next to the other side stand 7, 6, the relatively short distances allowing relatively short changing times for the forming tools 11. For this purpose, openings 13 running through the side stands 6, 7 for moving the forming tools 11 from the respective parking and changing positions into the central working position and back are formed in each of the two side stands 6, 7.

The tools of the calibrating and straightening tool 11*a* needed for calibrating the pipes 2 consist of a base tool (multiple sizes for different diameter ranges) and different shells for different diameters.

The bending tool 11*b* needed to bend the sheets 4 in order to produce pipes 2 consists of an upper tool and a lower tool. Depending on the pipe diameter of the pipe 2 to be produced later, a lower tool and at least one upper tool is provided per lateral end 3 of the sheet 4. To reduce the number of tools for identical pipe diameters with different sheet thicknesses, the tools can be displaceable for adaption to the different sheet thicknesses. The sheet 4 to be bent is pressed into the upper tool during forming, thereby obtaining its required contour.

For feeding the pipes 2 and sheets 4 to be formed, a feeding device 14 is assigned to the device 1, a discharging device 15 being provided for discharging the formed pipes 2 and sheets 4. The feeding device 14 is formed by an inlet roller conveyor 16 and the discharging device 15 is formed by an outlet roller conveyor 17. Both roller conveyors 16, 17 can be lowered and lifted so that in particular the sheets 4 rest freely in the forming tool 11 during forming.

For gradual straightening of the gradually calibrated pipes 2, the device 1 has centrally disposed V-blocks 18 for the respective pipe 2 upstream and downstream of the calibrating and straightening tool 11*a* in the conveying direction, said V-blocks 18 each being movable in the vertical direction by means of at least one pressure-operable cylinder. Here, too, the pressure fluid used is preferably hydraulic oil.

In the area of the inlet roller conveyor 16 and/or of the outlet roller conveyor 17, a centrally disposed rotating device 19 for rotating the respective pipe 2 and for laterally positioning the respective sheet 4 during bending is provided, said rotating device 19 being formed by multiple motor-driven roller pairs 21 disposed between parallel rollers 20 of the inlet roller conveyor 16 and/or of the outlet roller conveyor 17 and extending perpendicular to the rollers 20 of the inlet roller conveyor 16 and/or of the outlet roller conveyor 17. As mentioned before, after lowering of the roller conveyors 16, 17, the rotating device 19 allows the respective pipe 2 to be rotated into the correct straightening position very easily, the motor-driven roller pairs 21 ensuring precise automatic positioning of the pipe 2 for straightening. On the other hand, the rotating device 19 allows the respective sheet 4 to be very easily positioned laterally prior to bending of the lateral ends 3 thereof.

Hereinafter, the method for calibrating and straightening hollow components, preferably welded pipes 2, and for bending lateral ends 3 of sheets 4 to produce pipes 2 will be explained.

To calibrate and straighten a pipe 2 or multiple pipes 2, the calibrating and straightening tool 11*a* is moved from its parking and changing position outside the frame 5 of the device 1 into the working position within the frame 5 of the device 1. Then the ram 10 of the device 1 is moved toward the calibrating and straightening tool 11*a*, and the calibrating and straightening tool 11*a* is form-fittingly received by the ram 10 and fixed thereto. The respective pipe 2 is then fed to the calibrating and straightening tool 11*a* by means of the inlet roller conveyor 16 and gradually calibrated in the calibrating and straightening tool 11*a* according to the dimensions of the calibrating and straightening tool 11*a*. After completion of each individual step of calibration, the pipe 2 may be straightened, the rotating device 19 rotating the respective pipe 2 into the correct position for straightening once the inlet roller conveyor 16 and/or the outlet roller conveyor 17 has been lowered and, upon arrival of the pipe 2 in the correct position, the V-blocks 18 are moved against the pipe 2, the pipe 2 being straightened by the force acting against the pipe 2. Following full calibration and full straightening of the pipe 2, it is conveyed away from the calibrating and straightening tool 11*a* via the outlet roller conveyor 17. Upon completion of the calibration and after straightening of a single pipe 2 or of multiple pipes 2, the calibrating and straightening tool 11*a* is detached from the ram 10 of the device 1 and moved from the working position within of the frame 5 of the device 1 into its parking and changing position outside the frame 5 of the device.

In order to bend the lateral ends 3 of sheets 4 to produce pipes 2, the bending tool 11*b* is moved from its parking and changing position outside the frame 5 of the device 1 into the working position within the frame 5 of the device 1. Then the ram 10 is moved toward the bending tool 11*b*, and the bending tool 11*b* is form-fittingly received by and fixed to the ram 10 of the device 1. The respective sheet 4 is then laterally positioned by means of the rotating device 19 and is fed to the bending tool 11*b* by means of the inlet roller conveyor 16, the sheet is clamped, and then the longitudinal ends 3 of the sheet 4 are simultaneously bent in parallel at both sides in a cycled process or in a continuous process, at least the inlet roller conveyor 16 being in the lowered position during bending. When the sheet 4 is cycled or conveyed onward, the inlet roller conveyor 16 is lifted again, the bending tool 11*b* is opened and the sheet 4 is unclamped. Once the sheet 4 has been moved by the predefined increment, the next bending step takes place. Following full bending of the sheet 4, it is conveyed away from bending tool 11*b* the via the outlet roller conveyor 17. Once bending of a single sheet 4 or of multiple sheets 4 is complete, the bending tool 11*b* is detached from the ram 10 of the device 1 and moved from the working position within the frame 5 of the device 1 into its parking and changing position outside the frame 5 of the device 1.

For further processing and for the production of pipes 2, the bent sheets 4 can subsequently be fed to a bending press or another forming machine of the likes and then to a longitudinal welding machine, for example.

The invention claimed is:

1. A device (1) for calibrating and straightening hollow components, including welded pipes (2), the device (1) comprising:

a frame (5) having two side stands (6, 7), a lower cross member (8) and an upper cross member (9), a ram (10) being provided, said ram (10) being movable toward the lower cross member (8) and back by means of a pressure-operable cylinder assembly (12) supported on the upper cross member (9), a calibrating and straightening tool (11*a*) being provided between the lower cross member (8) and the ram (10), and a bending tool (11*b*), characterized in that the calibrating and straightening tool (11*a*) is changeably disposed on the lower cross member (8) and on the ram (10) and can be replaced with the bending tool (11*b*) for bending lateral ends (3) of sheets (4) to produce pipes (2);

wherein the bending tool (11*b*) comprises a lower tool and at least one upper tool adapted for simultaneously bending the lateral ends (3) of the sheets (4);

wherein upstream and downstream of the calibrating and straightening tool in a conveying direction, the device further includes centrally disposed V-blocks (18) for a respective pipe (2), each V-block being movable in a vertical direction by means of at least one pressure-operable cylinder, and wherein each V-block is configured to straighten the respective pipe (2) by the force of the V-blocks acting against the pipe.

2. The device according to claim 1, characterized in that the calibrating and straightening tool (11*a*) and the bending tool (11*b*) can each be alternatively moved from a parking and changing position outside the frame (5) of the device (1) into a working position within the frame (5) of the device (1) and back.

3. The device according to claim 2, characterized in that the parking and changing position of the calibrating and straightening tool (11*a*) is located sideways next to one of the two side stands (6, 7) of the frame (5) and the parking and changing position of the bending tool (11*b*) is located sideways next to the other side stand (7, 6) of the frame (5), wherein each of the two side stands (6, 7) includes at least one through-opening (13) for moving a respective one of the calibrating and straightening tool (11*a*) and the bending tool (11*b*) from the respective parking and changing positions into the working position within the frame.

4. The device according to claim 1, characterized in that the calibrating and straightening tool (11*a*) and the bending tool (11*b*) can both alternatively be form-fittingly received by the ram (10).

5. The device according to claim 1, characterized in that a feeding device (14) for the pipe (2) to be calibrated and straightened and for the sheet (4) to be bent and a discharging device (15) for the calibrated and straightened pipe (2) and for the bent sheet (4) are assigned to the device (1).

6. The device according to claim 5, characterized in that the feeding device (14) is formed by an inlet roller conveyor (16) and the discharging device (15) is formed by an outlet roller conveyor (17).

7. The device according to claim 6, characterized in that the inlet roller conveyor (16) and the outlet roller conveyor (17) can be lifted and lowered.

8. The device according to claim 1, characterized in that a centrally disposed rotating device (19) for rotating a respective pipe (2) and/or for laterally positioning a respective sheet (4) prior to bending is provided in the area of an inlet roller conveyor (16) and/or of an outlet roller conveyor (17).

9. The device according to claim 8, characterized in that the rotating device (19) is composed of multiple motor-driven roller pairs (21) which are disposed between parallel rollers (20) of the inlet roller conveyor (16) and/or of the outlet roller conveyor (17) and extending perpendicular to the rollers (20) of the inlet roller conveyor (16) and/or of the outlet roller conveyor (17).

10. The device according to claim 1, characterized in that a centering device is provided for centering a respective sheet (4).

11. A method for calibrating and straightening hollow components, including welded pipes (2), and for bending lateral ends (3) of sheets (4) to produce pipes (2), characterized by the following method steps:

a) providing a device (1) including a. a frame (5) having two side stands (6,7), a lower cross member (8) and an upper cross member (9);

b. a ram (10), said ram being movable toward the lower cross member (8) and back by means of a pressure-operable cylinder assembly (12) supported on the upper cross member (9);

c. a calibrating and straightening tool (11*a*) positioned between the lower cross member (8) and the ram (10); and d. a bending tool (11*b*) comprising a lower tool and at least one upper tool adapted for simultaneously bending the lateral ends (3) of the sheets (4);

wherein the calibrating and straightening tool (11*a*) is changeably disposed on the lower cross member (8) and on the ram (10) and is adapted to be replaced with the bending tool (11*b*) for bending lateral ends (3) of sheets (4) to produce pipes (2);

b) moving the calibrating and straightening tool (11*a*) from a calibrating and straightening tool parking and changing position into a working position, c) moving the ram (10) toward the calibrating and straightening tool (11*a*) and form-fittingly receiving the calibrating and straightening tool by the ram (10) and fixing the calibrating and straightening tool thereto, d) feeding a respective pipe (2) to the calibrating and straightening tool (11*a*) by means of an inlet roller conveyor (16) and calibrating the respective pipe within the calibrating and straightening tool (11*a*) according to dimensions of the calibrating and straightening tool (11*a*), e) lowering the inlet roller conveyor (16) and/or an outlet roller conveyor (17), rotating the respective pipe (2) into a correct position for straightening by means of a rotating device (19), moving V-blocks (18) against the respective pipe (2) upon arrival of the pipe (2) in the correct position, and straightening the respective pipe (2) by force of the V-blocks acting against the pipe (2), f) conveying the respective pipe (2) away from the calibrating and straightening tool (11*a*) via the outlet roller conveyor (17), g) detaching the calibrating and straightening tool (11*a*) from the ram (10) of the device (1) and moving the calibrating and straightening tool into the calibrating and straightening tool parking and changing position, h) moving the bending tool (11*b*) including the lower tool and the at least one upper tool from a bending tool parking and changing position into the working position, i) moving the ram (10) toward the bending tool (11*b*) and form-fittingly receiving the bending tool by the ram (10) of the device (1) fixing the bending tool thereto, j) laterally positioning a respective sheet (4) by means of the rotating device (19) and feeding the respective sheet to the bending tool (11*b*) by means of the inlet roller conveyor (16), clamping the sheet (4) between the lower tool and the at least one upper tool, and simultaneously bending longitudinal ends (3) of the respective sheet (4) in parallel on both sides of the sheet in a cycled process or a continuous process, at least the inlet roller conveyor (16) being in a lowered position during bending, k) opening the bending tool (11*b*) and simultaneously lifting the inlet roller conveyor (16) and unclamping the respective sheet (4), l) conveying the respective sheet (4) away from the bending tool (11*b*) via the outlet roller conveyor (17) and removing the respective sheet by means of a lifting device, m) detaching the bending tool (11*b*) from the ram (10) of the device (1) and moving the bending tool from the working position into the bending tool parking and changing position.

* * * * *